US009624021B2

(12) United States Patent
Bodet et al.

(10) Patent No.: US 9,624,021 B2
(45) Date of Patent: Apr. 18, 2017

(54) DISPENSING MODULE

(71) Applicant: Bayer MaterialScience AG, Leverkusen (DE)

(72) Inventors: Herve Bodet, Verdun (FR); Eric Gaillard, Dieue sur Meuse (FR); Thomas Walter, Langenau-Albeck (DE); David Kaiser, Rottenacker (DE); Clemens Reizel, Ulm (DE)

(73) Assignee: Covestro Deutschland AG, Leverkusen (DE)

( * ) Notice: Subject to any disclaimer, the term of this patent is extended or adjusted under 35 U.S.C. 154(b) by 0 days.

(21) Appl. No.: 14/593,026

(22) Filed: Jan. 9, 2015

(65) Prior Publication Data

US 2015/0122836 A1 May 7, 2015

Related U.S. Application Data

(63) Continuation of application No. 13/817,044, filed as application No. PCT/EP2011/063910 on Aug. 12, 2011, now abandoned.

(30) Foreign Application Priority Data

Aug. 16, 2010 (EP) ..... 10172924

(51) Int. Cl.
*B67D 7/70* (2010.01)
*B65D 81/32* (2006.01)
(Continued)

(52) U.S. Cl.
CPC ..... *B65D 81/325* (2013.01); *B05B 11/0048* (2013.01); *B05B 11/3081* (2013.01);
(Continued)

(58) Field of Classification Search
CPC ..... B05B 11/3067; B05B 11/0018; B05B 11/0097; F16J 1/09; F16J 1/008; B65D 83/64; B65D 83/0033
(Continued)

(56) References Cited

U.S. PATENT DOCUMENTS 3,140,078 A 7/1964 Grubb
3,380,451 A 4/1968 Porter
(Continued)

FOREIGN PATENT DOCUMENTS

CH 337744 A 4/1959
DE 2007199 A1 9/1970
(Continued)

*Primary Examiner* — Kevin P Shaver
*Assistant Examiner* — Michael J Melaragno
(74) *Attorney, Agent, or Firm* — Drinker Biddle & Reath LLP

(57) ABSTRACT

The invention relates to a dispensing module for two liquid products, comprising: a first chamber (20) having a first wall, said first chamber having a first opening; a first piston (61) which can be displaced while resting on the wall of the first chamber; a second piston (64) which can be displaced while resting on a wall of the second chamber, and coupling means (62) for coupling both pistons while the product is being dispensed are provided. According to the invention, in order to prevent functional dysfunctions in the event of a distortion of the shape of container and to freely select the shape of the container, said dispensing module comprises a second chamber, the wall of which can be displaced while resting on the second piston, said second chamber comprising a second opening. This is achieved by virtue of the fact that the distortion of the container no longer leads to functional dysfunctions of the dispensing module. Also, the outer shape of the container can be freely selected.

9 Claims, 5 Drawing Sheets

Figure 1:
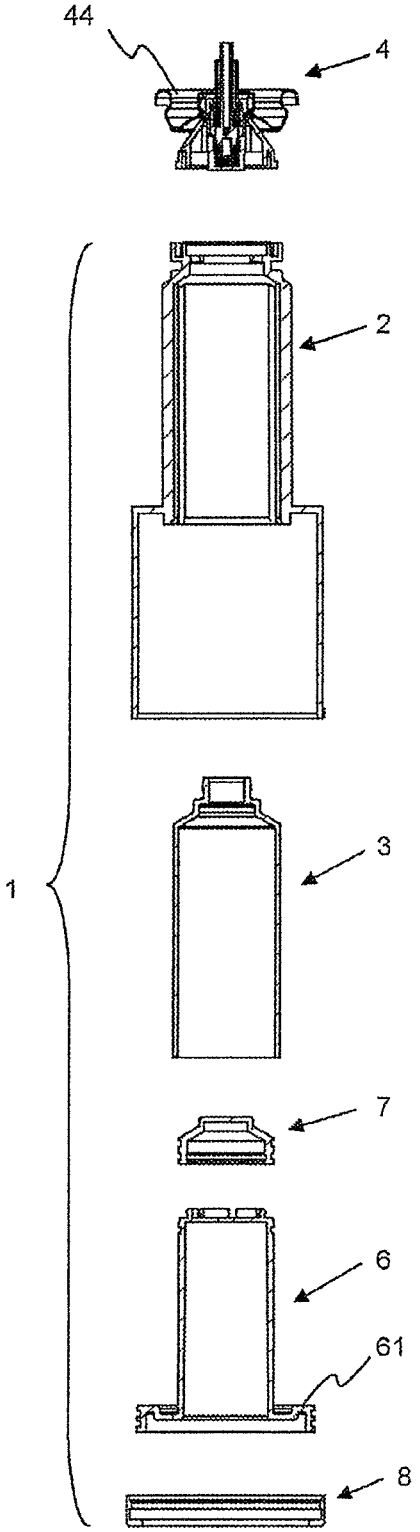

(51) Int. Cl.

| | |
|---|---|
| ***B67D 7/74*** | (2010.01) |
| ***B05B 11/00*** | (2006.01) |
| ***B05C 17/005*** | (2006.01) |
| ***B65D 83/64*** | (2006.01) |
| ***B65D 83/68*** | (2006.01) |

(52) U.S. Cl.
CPC ..... *B05C 17/00559* (2013.01); *B65D 83/64* (2013.01); *B65D 83/682* (2013.01); *B67D 7/741* (2013.01)

(58) Field of Classification Search
USPC ..... 222/135, 136, 137, 389, 387, 394, 402.1
See application file for complete search history.

(56) References Cited

U.S. PATENT DOCUMENTS 3,525,997 A * 8/1970 O'Donnell ..... B65D 83/60 222/136
3,593,886 A * 7/1971 Morane ..... B65D 83/682 222/136
3,593,887 A * 7/1971 Morane ..... B65D 83/682 222/136
3,675,821 A 7/1972 Morane et al.
3,813,011 A * 5/1974 Harrison ..... B65D 83/20 222/136
3,885,710 A 5/1975 Cohen
3,915,345 A 10/1975 Harrison et al.
4,014,463 A 3/1977 Hermann
4,220,261 A 9/1980 White
5,015,101 A 5/1991 Draenert
5,139,171 A * 8/1992 Mader ..... B05C 17/00553 222/137
5,310,091 A * 5/1994 Dunning ..... B65D 81/325 222/135
5,551,601 A 9/1996 Camm et al.
5,566,860 A * 10/1996 Schiltz ..... B05C 17/00513 222/105
5,598,762 A 2/1997 Sneddon
5,647,510 A * 7/1997 Keller ..... B05C 17/00513 222/105
5,673,821 A * 10/1997 Davis ..... B05B 11/0048 222/137
5,823,394 A * 10/1998 Davis ..... B05B 11/0048 222/137
5,836,235 A 11/1998 Rudiger et al.
5,921,167 A 7/1999 Giesy et al.
6,315,173 B1 * 11/2001 Di Giovanni ..... B65D 83/54 222/402.1
6,474,513 B2 * 11/2002 Burt ..... B65D 83/54 222/402.1
6,681,957 B1 * 1/2004 Green ..... A61C 5/064 222/135
6,848,480 B2 * 2/2005 Brennan ..... B05C 17/00553 141/100
7,237,693 B2 * 7/2007 Brennan ..... B05C 17/00506 222/137
7,431,179 B2 * 10/2008 Ritter ..... B05C 17/00553 222/135
7,481,333 B2 * 1/2009 Goldberg ..... B05C 17/00506 222/1
8,317,062 B2 * 11/2012 Bodet ..... B65D 83/62 222/105
8,505,775 B2 * 8/2013 Bodet ..... B65D 83/62 222/105
8,511,518 B2 8/2013 Monti
8,631,973 B2 * 1/2014 Grundler ..... A61C 5/064 222/137
8,672,186 B2 3/2014 Geiberger
8,881,950 B2 11/2014 Pappalardo
2002/0108968 A1 * 8/2002 Dumont ..... B01F 5/0696 222/136
2003/0024953 A1 * 2/2003 Lilienthal ..... B65D 83/36 222/402.1
2008/0083789 A1 4/2008 Brugner
2009/0230344 A1 * 9/2009 Bodet ..... B65D 83/62 251/367
2010/0147895 A1 6/2010 Helmenstein
2010/0276458 A1 11/2010 Buck
2012/0104044 A1 * 5/2012 Pappalardo ..... B05C 17/005 222/137
2013/0092710 A1 * 4/2013 Bodet ..... B65D 83/425 222/402.2

FOREIGN PATENT DOCUMENTS

| | | | |
|---|---|---|---|
| DE | 29905762 | U1 | 9/1999 |
| DE | 10132417 | A1 | 1/2003 |
| DE | 202007004662 | U1 | 8/2008 |
| WO | WO-2007109229 | A2 | 9/2007 |
| WO | WO-2007132017 | A1 | 11/2007 |
| WO | WO-2009021033 | A1 | 2/2009 |

* cited by examiner

DISPENSING MODULE

RELATED APPLICATIONS

This application is a continuation of U.S. patent application Ser. No. 13/817,044, filed Mar. 18, 2013, which claims benefit of national stage application, under 35 U.S.C. §371, to PCT/EP2011/063910, filed Aug. 12, 2011, which claims priority to European Application No. 10172924.2, filed Aug. 16, 2010. Each disclosure of the aforementioned priority applications is incorporated herein by reference in its entirety.

The invention relates to a dispensing module for two liquid products, said dispensing module including:

- a first chamber with a first wall, wherein the first chamber has a first opening,
- a first piston which is displaceable abutting against the wall of a first chamber,
- a second piston which is displaceable abutting against a wall of a second chamber, wherein coupling means are provided for coupling the two pistons during product dispensing, wherein the dispensing module has a second chamber, the second piston being displaceable abutting against the wall of said second chamber, wherein the second chamber has a second opening.

The term liquid products in the present application refers to all products which can be output by means of a dispensing module, that is to say also highly viscous or gaseous products as well as solids dispersed in a gas.

It is frequently necessary to separate two products contained in one container until the point of their use in order, for example, to avoid unwanted chemical reactions between the products. In such cases, the two products are kept in two chambers of the container, which are separated apart from each other, and are conveyed by means of two-way valves or two-way pumps to the dispensing opening where they come into contact with each other.

If, as in the case of WO 2007/132 017 A1, two bags are provided for the two products, it is difficult to convey the two products in an even defined mixing ratio. This can cause problems for example in the case of drugs or in the case of adhesives.

Two-piston systems are also known. DE 20 2007 004 662 U1 makes known a container with two pistons which are arranged one above the other and slip along the wall of the container. A two-way pump is arranged on the container. A first way of the pump opens out at the top end of the container. The second way opens out in a line which traverses the first piston and the latter can slip along the same. The first product is situated in the space above the first piston, whilst the second product is situated in the space between the first and the second piston. The risk of conveying the two products in an insufficiently precise mixing ratio is relatively great also in the case of said device.

Said disadvantage is avoided in that the two pistons are coupled together in a mechanical manner such that when the one piston is displaced, the other piston is also displaced in a corresponding manner. This solution proceeds from documents U.S. Pat. No. 3,915,345 A or DE 20 07 199 A. In both cases, there is a central cylinder which is fastened to a two-way valve. Said two-way valve is fastened on a housing which is also cylindrical. A first piston slides along the inner wall of the central cylinder and thus forms a first chamber, whilst a second circular ring-shaped piston slides along the outer wall of the central cylinder by way of its central edge and along the wall of the housing by way of its outer edge and thus forms the second chamber. The two pistons are connected together. In the case of document U.S. Pat. No. 3,915,345 A, they are connected by a double wall which surrounds the bottom edge of the central cylinder. In the first exemplary embodiment of DE 20 07 199 A, the two pistons are separated by a circular ring-shaped space and by way of their bottom ends are connected by means of a base plate. The propellant necessary for the common displacement of the two pistons is situated under the base plate or under the piston.

Both in the case of DE 20 2007 004 662 U1 and in the case of DE 20 07 199 A or U.S. Pat. No. 3,915,345 A, one of the pistons slides along the inner surface of the container. Said container, consequently, has to be developed absolutely cylindrically such that a free selection of shape is impossible. Over and above this, there is the risk that the container deforms in the event of knocks. If the deforming is situated in the part that is arranged below the bottom-most piston, this is not a problem. However, if the deforming takes place in a region that has to be run through by one of the two pistons, the likelihood of an operating fault is great. The piston is either not able to pass the deformation and consequently is not able to dispense any product or the piston is able to pass the deformation, but is deformed in doing so, thereby producing a leak and the product escapes into the region intended for the propellant.

The object of the invention, consequently, is to prevent operating faults in the event of deformation of the container and to make it possible to select the shape of the container freely.

Said object is achieved in that the coupling means have a part which connects the first piston to the second piston, wherein the first piston, the part and the second piston form one piston unit, wherein the first chamber is realized in the shape of a circular ring and is defined in its central region by the part of the piston unit and wherein the second chamber is arranged concentrically with respect to the first chamber and above said first chamber and the first piston and/or the second piston have a piston head which is first of all separated from the coupling means and once the dispensing module has been filled with the products is connected to the coupling means in an irreversible manner.

The first and the second wall are preferably realized in a cylindrical manner, other developments, however, also being conceivable, for example walls with an oval cross section.

The achievement of the solution as claimed in the invention is that when using the dispensing module in a container with suitable dispensing means, deformation of the container no longer produces operating faults in the dispensing module. In addition, the outer shape of the container can be freely selected, which makes it possible to develop said container in an application-friendly manner by improving the grip of the container or the ergonomy thereof.

Usually piston systems have a product pressure in the chamber and a gas pressure below the piston. To dispense and evacuate said piston systems of the prior art, it is then crucial that the gas pressure is higher than the product pressure. The maintaining of the product consistency or homogeneity provides a further aspect. Especially in the case of product mixtures in which liquid gas or compressed gas is dissolved, the gas in the chamber is relieved or separated out when the product pressure is higher compared to the gas pressure and thus leads to unwanted product changes. Contrary to this, through the structural development of the piston system the solution as claimed in the invention enables the ability to evacuate and the maintaining of the homogeneity of the product formulation even if the smaller product chamber has a higher pressure than the outer gas pressure. This is achieved by the greater surface pressure of the larger piston onto the smaller piston.

One development of the invention is that the coupling means traverse the first chamber and move the surface of the first piston facing away from the opening of the first chamber into contact with the surface of the second piston facing away from the opening of the second chamber.

It is within the framework of the invention that fastening means are provided in order to connect the dispensing module to removal means or means for closing the openings of the chambers.

The part which connects the first piston to the second piston is preferably realized in a cylindrical manner, other developments also being conceivable in principle here too corresponding to the development of the wall.

In addition, it is expedient that removal means which are connected to the openings of the chambers are provided.

In this connection, it is advantageous that the removal means include a two-way valve or a two-way pump, wherein the first way is connected to the opening of the first chamber and the second way is connected to the opening of the second chamber.

The invention also claims that the removal means include a metering device.

It is also advantageous that closing means are provided in order to close the openings of the first chamber and of the second chamber, wherein the closing means have an open and a closed position.

Finally, it is provided within the framework of the invention that a housing which is fastened to the dispensing module or to the removal moves or to the closing means is provided.

Figure 2:
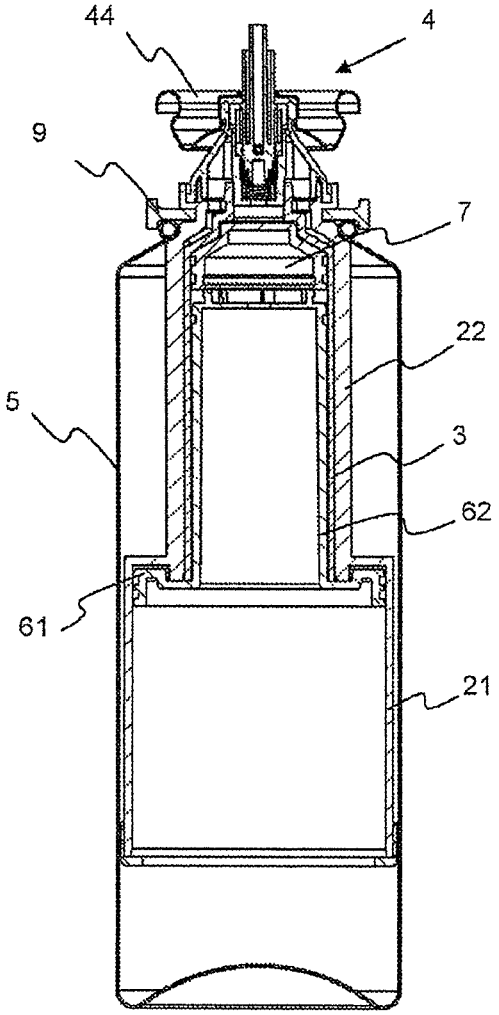
Figure 3:
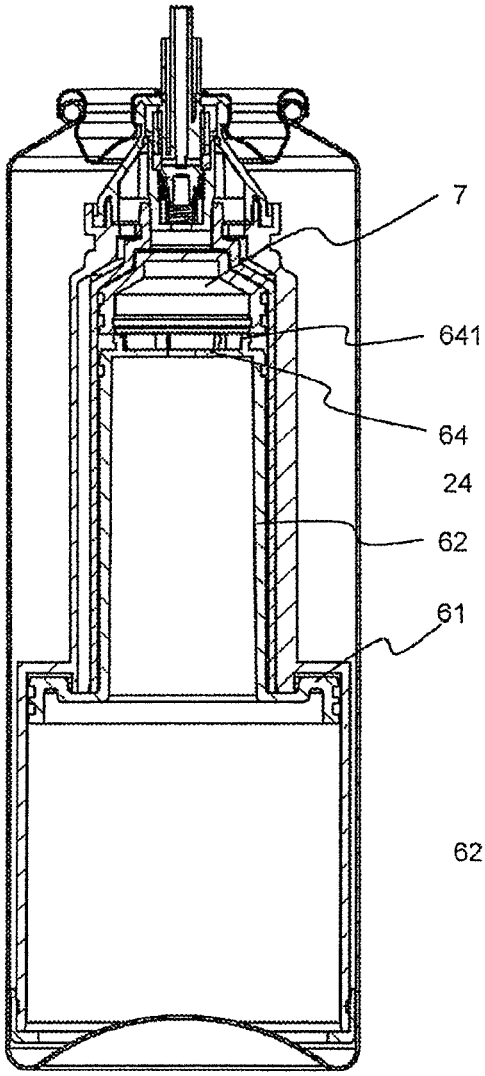
Figure 4:
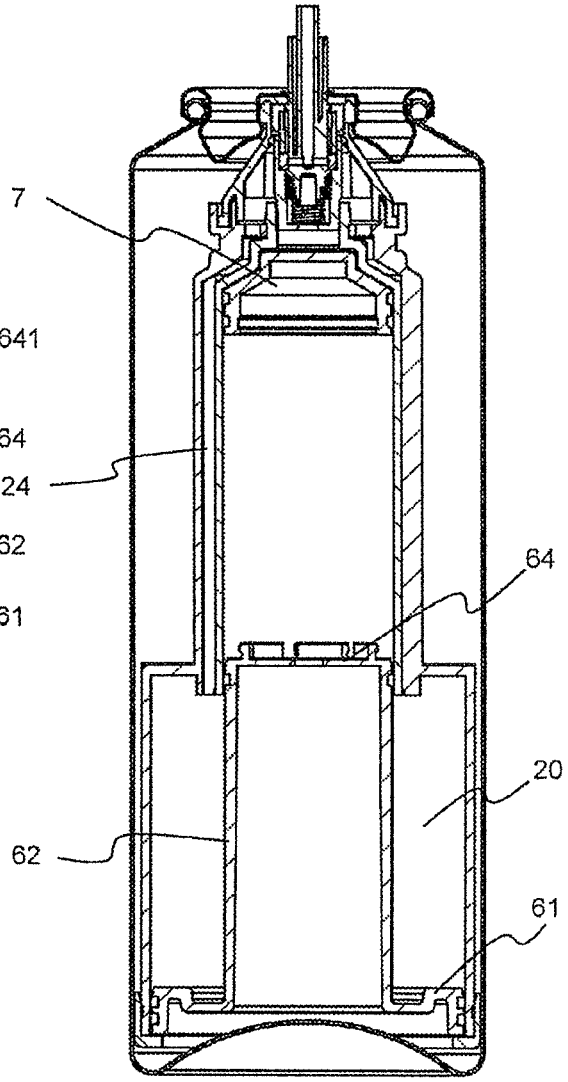
Figure 5:
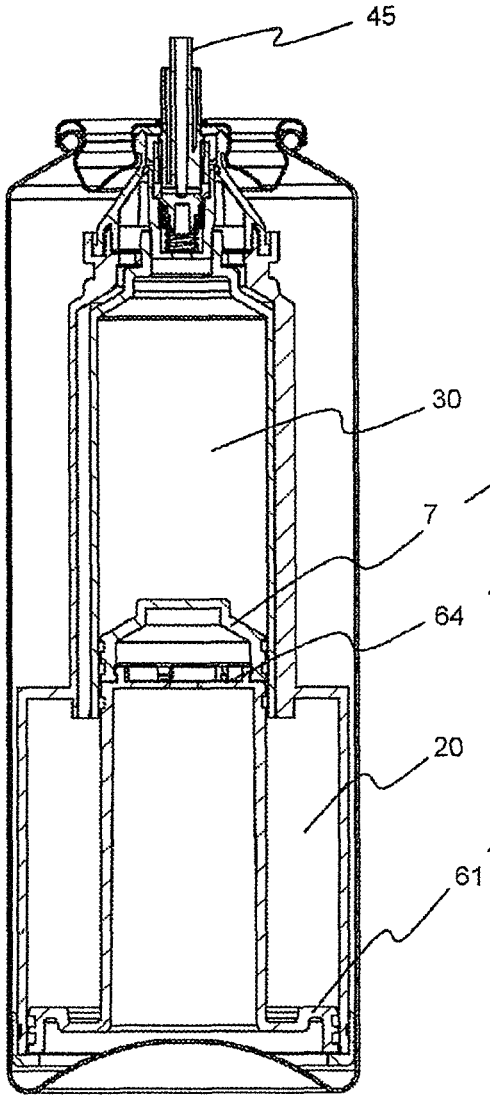
Figure 6:
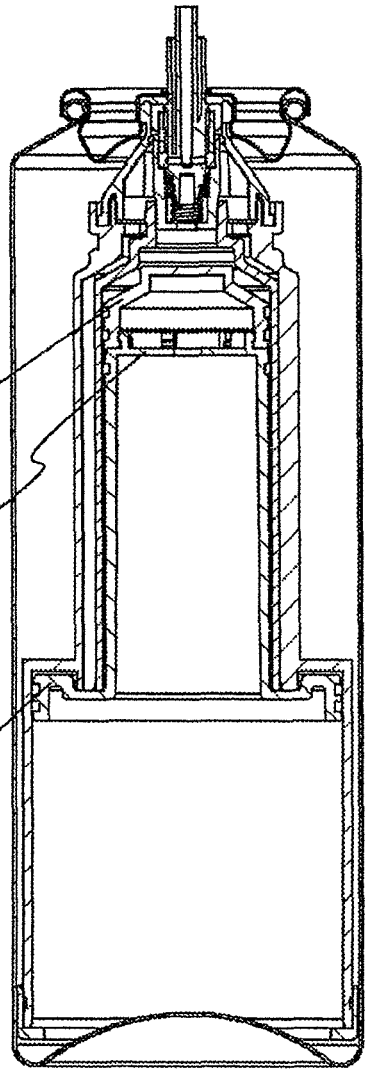
Figure 7:
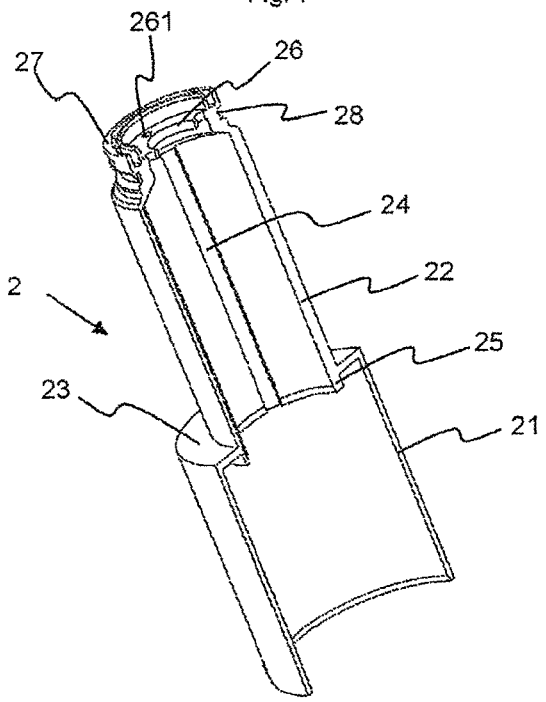
Figure 8:
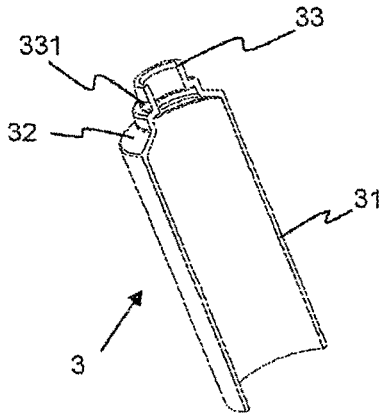
Figure 9:
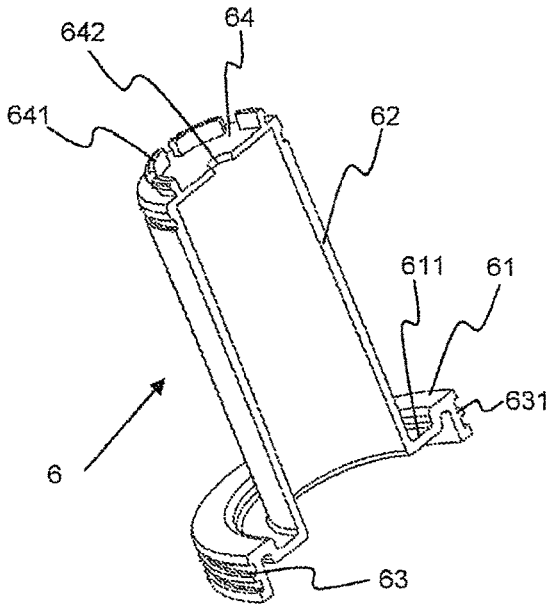
Figure 10:
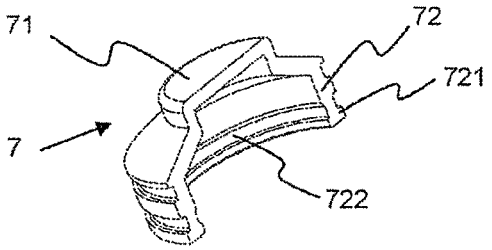
Figure 11:
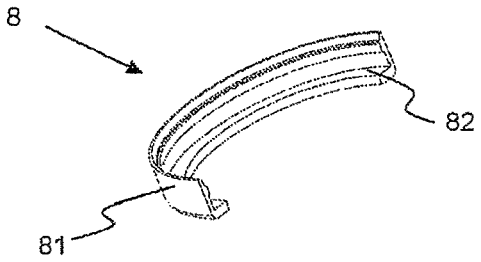
Figure 12:
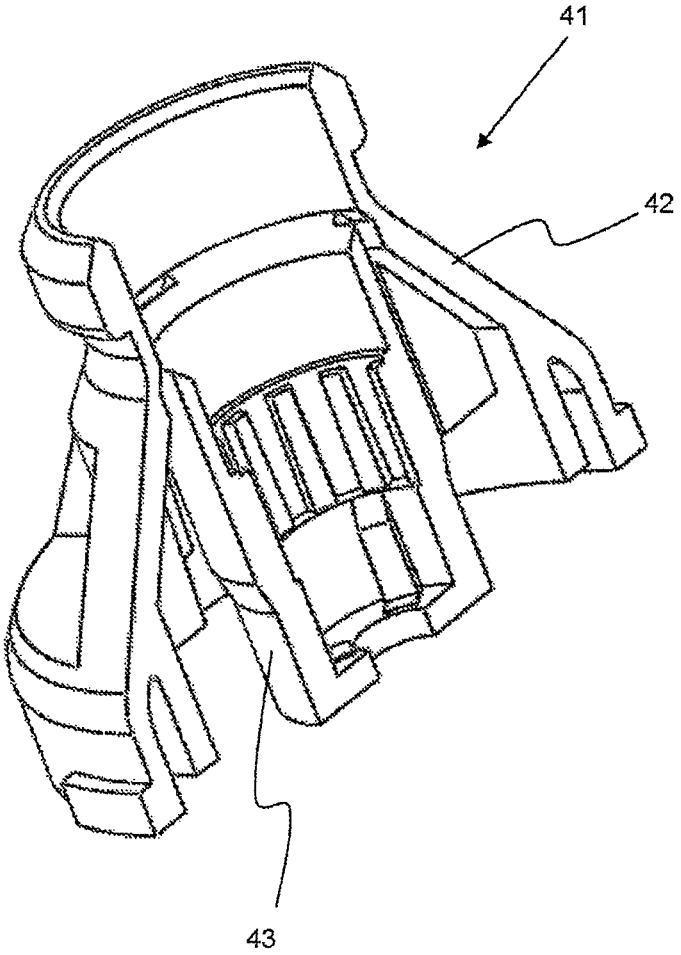

An exemplary embodiment of the invention is described below by way of drawings, in which:

FIG. 1: shows an exploded drawing of the dispensing module as claimed in the invention;

FIG. 2: shows a sectioned side view of a container during assembly;

FIG. 3: shows a sectioned side view of the container according to FIG. 2, which can be filled;

FIG. 4: shows a sectioned side view of the container according to FIG. 2 where the first product has been filled into the first chamber;

FIG. 5: shows a sectioned side view of the container according to FIG. 2 after the second product has been filled into the second chamber;

FIG. 6: shows a sectioned side view of the container according to FIG. 2 after evacuation;

FIG. 7: shows a sectioned perspective representation of the outer casing;

FIG. 8: shows a sectioned perspective representation of the inner casing;

FIG. 9: shows a sectioned perspective representation of the piston unit including latching means showing individual tabs;

FIG. 10: shows a sectioned perspective representation of the head of the second piston;

FIG. 11: shows a sectioned perspective representation of the stop for the first piston;

FIG. 12: shows an enlarged representation of the valve housing.

The invention relates to a dispensing module (1) with two chambers (20, 30), said dispensing module being fastened to a valve (4) of a container (5), preferably a pressure container. Each chamber (20, 30) is provided with a piston (61, 64 and 7). Coupling means are provided in order to couple the two pistons (61, 64 and 7) together once the chambers have been filled such that they are moved simultaneously. The valve (4) is preferably a two-way valve such that the product contained in the first chamber (20) does not come into contact with the product from the second chamber (30) until exiting from the valve (4) or possibly until exiting from the outlet opening fastened to the valve (4).

The invention also relates to the dispensing module (1) fastened to the valve (4) and to the container consisting of a valve (4) which is provided with a dispensing module (1) and is fastened on a housing (5).

The dispensing module (1) consists essentially of an outer casing (2), the first piston (61) sliding in a part (21) of said outer casing and forming the first chamber (20), of an inner casing (3) in which the second piston (64 and 7) slides and forms the second chamber (30), of coupling means (62) in order to couple the two pistons (61, 64 and 7) together and retaining means (8) in order to serve as a stop for the first piston (61).

The outer casing (2) consists of a first, bottom cylindrical part (21) and a second top cylindrical part (22) with a smaller diameter. The two cylindrical parts are connected together by means of a radial connecting wall (23). In the exemplary embodiment shown, the wall of the second cylindrical part penetrates slightly into the top part of the first cylindrical part (21) by penetrating the radial wall (23). Said projection (25) serves as a top stop for the first piston (61). However, it would also be possible to dispense with said projection and to use the radial wall as a stop. The second cylindrical part (22) has in its top region a ring-shaped radial shoulder (26) which is penetrated by one or several openings (261). It is achieved in this way that the first casing is realized in a tubular manner with openings at both ends. Channels (24) are arranged on the inside surface of the second cylindrical part (22). They extend over the entire height of said second part (22). The top surface of the second cylindrical part is provided with fastening means (27), by way of which the two-chambered dispensing module (1) is fastened to the two-way valve (4). Said fastening means (27) include a crown which is provided with latching means which can interact with complementary latching means on the two-way valve (4).

The inner casing (3) consists substantially of a cylindrical main part (31), the outside diameter of which corresponds substantially to the inside diameter of the second cylindrical part (22) of the outer casing (2). The cylindrical main part (31) is tapered in its top region, preferably by forming a truncated cone-shaped wall (32) and is closed off with a cylindrical part which forms a sleeve (33). Just as the outer casing (2), the inner casing also has a tubular form with openings at both ends. The sleeve (33) has a ring-shaped radial groove (331) which is open to the outside and the bottom diameter and height of which correspond to the inside diameter and the height of the ring-shaped shoulder (26) of the second cylindrical part (22) of the outer casing (2). Consequently, the inner casing (3) can be inserted into the interior of the top cylindrical wall (22) of the outer casing (2) until the sleeve (33) engages into the opening in the center of the ring-shaped shoulder (26) and said shoulder (26) engages in the groove (331). In this way, the inner casing (3) is fastened in a fixed manner in the interior of the outer casing (2). The length of the inner casing (3) is selected such that the bottom end, in the position locked into the outer casing (2), is aligned with the bottom end of the top cylindrical part (22) of the outer casing (2). The inner casing (3) serves, with the channels (24), for the purpose of defining the outlet lines for the product contained in the second chamber (20). For this purpose, the channels (24) are dimensioned such that they open out in the space, which is arranged above the truncated cone-shaped wall (32), but below the ring-shaped shoulder (26).

The two pistons are combined in one piston unit (6). The first piston has a radial ring-shaped part (61) which is fastened to the bottom end of a cylindrical part (62). At its edge, the radial ring-shaped part (61) has an axial rim (63) which extends proceeding from the surface of the ring-shaped part (61) which faces away from the cylindrical part (62). The outside diameter of said rim (63) corresponds to the inside diameter of the first cylindrical part (21) of the outer casing. The rim (63) is provided with sealing means in order to seal off the piston (61) to the inside surface of the bottom part (21) of the outer casing (2). Said sealing means are realized, for example, as free-flowing, highly-viscous sealing means in the form of sliding gels or as sealing lips (631) which consist, for example, of elastomer materials. The outside diameter of the cylindrical part (62) of the piston unit (6) corresponds substantially to the inside diameter of the inner casing (3).

In this way, the first chamber (20) is formed by a ring-shaped space between, on the one hand, the cylindrical bottom part (21) of the outer casing and the cylindrical part of the piston unit (62) and, on the other hand, between the first piston (61) and the radial part (23) of the outer casing which connects the bottom part (21) and the top part (22). Said first chamber (20) is open toward the outside by means of the channels (24), the space between the truncated cone-shaped part (32) of the inner casing and the shoulder (26) of the outer casing as well as the openings (261).

The ring-shaped groove (611) is present in the first piston (61) at the connecting point to the cylindrical part (62). The shape of said ring-shaped groove (611) is complementary to that of the projection (25) of the outer casing (2).

The first piston (61) can slide in the interior of the bottom cylindrical part (21) of the outer casing (2). In order to prevent it escaping from the same, it is provided that once all the parts of the dispensing module (1) have been inserted into the outer casing (2), retaining means (8) are fastened to the bottom end of the same. Said retaining means (8) are realized as an axial rim (81), the inside diameter of which corresponds substantially to the outside diameter of the bottom cylindrical part (21) of the outer casing. Said axial rim (81) extends in its bottom region beyond a ring-shaped radial wall (82) toward the center. The retaining means (8) are fastened to the bottom end of the bottom part (21) of the outer casing (2), for example by way of latching means. The piston (61) can consequently be displaced between a first position, in which it strikes against the radial wall (23) of the outer casing (2) (see FIG. 3) and a second position in which its bottom rim (63) strikes against the ring-shaped wall (82) of the retaining means (8) (see FIG. 4).

The second piston (64) is formed by the top surface (64) of the cylindrical part (62) of the piston unit (6). Said cylindrical part (62) consequently serves as coupling means which make it possible to displace the two pistons (61, 64) simultaneously.

A piston head (7) is fastened to the top surface (64) in the exemplary embodiment shown here. However, it would also be possible to realize the piston head in one piece directly on the top surface.

The piston head (7) consists substantially of a radial circular wall (71) which is lengthened downward by a rim (72). Sealing means are provided on the outer surface of the rim in the form of sealing lips (721). The outside diameter of the rim (72) corresponds to the inside diameter of the cylindrical main part (31) of the inner casing (3).

Consequently, the second chamber (30) is defined by the space between, on the one hand, the inner surface of the inner casing (3) and, on the other hand, the truncated cone-shaped part (32) of the same and the piston (64 or 7). It is open toward the outside in the region of the top opening of the sleeve (33). The head (7) of the piston (64) also serves as a sealing ring for the top part of the first chamber (20).

The head (7) of the piston (64) is provided with latching means (722) which make it possible to lock it into place in an irreversible manner on complementary latching means (641) which are arranged on the top surface (64) of the piston unit (6). Said latching means (641, 722) are dimensioned such that a sufficiently strong pressure has to be exerted onto the piston head (7) so that it locks into place on the top surface of the piston (64), and in a preferred manner is provided with one or several grid elements which are able to balance out possible fill tolerances. In this way, unwanted engagement is avoided, in particular during storage or when the empty dispensing modules are being handled. In addition, the height of the cylindrical main part (31) of the inner casing (and consequently the height of the top cylindrical part (22) of the outer casing) is selected such that when the piston unit (6) is situated in the top position, in which the first piston (61) strikes against the radial connecting wall (23), there is sufficient space in the interior of the inner casing for the cylindrical part (62) and the released, non-engaged piston head (7).

When assembling, the inner casing is first of all fastened in the outer casing, the piston head (7) is inserted into the interior of the inner casing (3), the piston unit (6) is then inserted, it being inserted as far as possible, i.e. until the first piston (61) strikes against the connecting wall (23). In this position, the piston head (7) is situated above the top part of the piston unit (6) without being locked in place therein. The sealing means (631, 721) of the two pistons (61, 64) exert sufficient pressure onto the inner wall of the respective chamber in order to hold the piston unit (6) and the piston head (7) in their position for as long as no product is filled in.

Such a unit with two chambers is intended for the purpose of being fastened on dispensing means, such as a two-way valve (4) or a two-way pump. It is also possible to provide only closing means which are opened during the dispensing operation. The dispensing means can include metering means such that, when the dispensing means are actuated, a predetermined amount of each of the products is output. Two-way valves are known, for example from documents U.S. Pat. No. 3,915,345 A or WO 2007/132 107 A1. In the example shown here, this is a two-way valve of the type described in the last-mentioned document. The method of operation of said valve is consequently not described in any more detail, but only the characteristic features which are produced within the framework of its application in a two-chambered system as claimed in the invention are explained below.

The valve body (41) includes a first part in the form of a collar (42) which is bulged downward and a second central part in the form of a cylindrical faucet (43), the part in the form of the collar (42) surrounding the faucet-shaped part (43). The collar-shaped part (42) is provided at its bottom end with holding means which complement those (27) of the outer casing (2). Said holding means are dimensioned such that a tight connection between the outer casing (2) and the collar-shaped part (42) is created. On the other hand, the faucet-shaped part (43) is dimensioned such that it penetrates into the sleeve (33) of the inner casing and ensures a tight connection here too. The valve is provided with two separate paths, one of which opens out in the space between the collar (42) and the faucet (43) and the other opens out in the interior of the faucet (43). In this manner, when the dispensing module (1) is fastened to the valve (4), the first chamber opens out in the first way and the second chamber in the second way of the valve.

As in the case of the two-way valve of document WO 2007/132 017 A1, it is possible to provide one or several openings in the body of the valve (41) such that the gas is able to escape along the same path as the first product when the valve is actuated. There is nothing against providing the propellant with a third product to which it does not react. The container then contains three products which are separated spatially during storage.

The unit consisting of the two-chambered dispensing module (1) and the dispensing means (4) can then be fastened in a housing (5). If the dimensions of the dispensing unit (1) and in particular of the outside diameter of the outer casing (2) and/or of the diameter of the valve disk (44) of the dispensing means allow, the dispensing module (1) can be inserted into the inner region of a prefabricated housing. Otherwise, it is necessary to realize the housing (5) around the dispensing module (1). This is the case with the example shown in the figures. A first advantage of the dispensing module consists in the fact that it is possible to use an arbitrary-shaped housing, in particular a housing with cam-contoured or profiled exteriors. Whilst the inner surface of the housing in the prior art has to be realized in a precisely cylindrical manner in order to make it possible for the piston to slide along, it is now possible to use housings with an elegant or ergonomic shape. A second advantage consists in that deformations of the housing have no influence on the operating of the piston. Whilst in the prior art, the smallest bulge could prevent the piston sliding along on the housing or its deformation could produce a leak from the first chamber, the container provided with the dispensing module as claimed in the invention is impact-resistant.

FIG. 3 shows a container provided with a dispensing module (1) fastened to a two-way valve (4), the two-way valve (4) being fastened on the neck of the housing (5). The gas has already been brought into the housing and exerts pressure both onto the first piston (61) and onto the second piston (64) or in the present case onto the piston head (7). The container can now be filled with the two products. In this connection, first of all, by means of the first way of the dispensing means (4), then the openings (261) and the channels (24), the first product is filled into the first chamber (20). The piston unit (6) is pushed back by the incoming product which presses onto the piston (61). If the second piston has a separate piston head (7) as in the example shown, said separate piston head remains in its initial position, i.e. in the top region of the second chamber (30), whilst the top part (64) of the piston unit (6) is pushed downward by the first piston (61). An opening (642) in the top part of the piston unit (6) prevents a vacuum forming between the fixed piston head (7) and the top part of the piston (64) which is moving downward. At the end of the fill operation of the first chamber (20), the rim (63) of the first piston (61) strikes against the ring-shaped radial wall (82) of the retaining means (8), as shown in FIG. 4.

The second product can then be filled into the second chamber (30) by means of the second way of the valve (4) and the faucet (43) as well as the sleeve (33). The incoming product presses the piston head (7) downward. The gas in the space between the interior of the cylindrical part (62) of the piston unit is pressed out in the top part (64) of the piston unit by means of the opening (642). The pressure exerted onto the piston head (7) by the second product is sufficient in order to overcome the resistance of the latching means (641, 722) and to lock the piston head (7) in place in the piston unit (6). The two pistons (61, 64) then are coupled together and can just be moved simultaneously. This corresponds to the situation shown in FIG. 5. A spray head still has to be placed in position on the rod (45) of the valve and possibly a protective cap mounted thereon. The container is ready for use. Thanks to the separate piston head (7), it is possible to fill the container at two separate fill units.

If contrary to the design shown in the present example, the second piston is realized directly on the top surface of the piston unit (6), said surface does not have any opening (642), the moving down of said top surface, which assumes the role of the piston, allows air to penetrate into the second chamber (30), which is formed at the same time as the first one. Consequently, air which is contained in said second, already realized chamber (30) has to be sucked off before the second product is filled in.

It is understandable for the chambers (20, 30) not to be formed until the product is filled in. If a separate piston head (7) is provided for the second chamber (30), said second chamber (30) is not realized at the same time as the first chamber (20). On the contrary, it is not formed until the second product is filled. It is consequently not necessary to provide a suction device for withdrawing the air from the second chamber before the second product is filled in.

Depending on the composition of the products used, after the filling of the first chamber and prior to the filling of the second chamber as well as possibly also after the filling of the second chamber, it is necessary to clean the parts contacted by the products in order to avoid unwanted reactions between the products or the contamination thereof.

The ratio between the initial volume of the first and of the second product is determined by the ratio between the surface of the first (61) and of the second piston (64). The dispensing module consequently makes a very high degree of precision possible, which is what is required for the ratio between the initial volume of the two products. As a result of the area ratio between the area of the first piston (61) and of the second piston (64), it is also possible to fill the second chamber (30) at a higher pressure than the external pressure.

It is obvious that the first piston (61) can also be realized with a separate piston head. The piston head is then ring-shaped and the filling starts with the second chamber (30) and not with the first chamber (20) if only the first piston has such a piston head. The height of the first cylindrical part (21) of the outer casing and/or of the cylindrical part (62) of the piston unit has to be sufficiently large in order to make it possible for the piston unit (6) to be able to penetrate completely into the inner casing, said piston unit impacting by way of its top part without the ring-shaped piston head locking into place in the piston unit (6). If the first piston (61) has a removable piston head, it is not necessary for the second piston (64) also to be provided with a separate piston head (7).

If the dispensing module (1) is used on a pressure container, as is the case in the example shown here, it can then be sensible to fasten the unit comprising the dispensing unit (1) and the dispensing means (4) in the housing (5), the valve disk (44) not being fastened to the housing (5). This makes it possible to fill in the propellant during the filling before the valve disk (44) is fastened on the housing (5). In order to secure the unit comprising dispensing module/dispensing means in said position (as shown in FIG. 2), there is provided a fork (9) which blocks the unit such that the tip of the second cylindrical part (22) of the outer casing strikes against the inner surface of the top surface of the housing (5). Said removable fork (9) penetrates into a groove (28) which is provided for this purpose at the tip of the outer casing (2) below the fastening means (27).

As an alternative to this, it is also possible to fasten the valve disk (44) to the housing (5) of the pressure container, then to fill the dispensing module (1) and to fill in the gas by means of an opening in the bottom of the pressure container which is subsequently closed. If the gas is filled in from above, provision must be made for the gas to be able to flow as far as the bottom for example by means of channels provided for this purpose.

Compressed gases, such as nitrogen, oxygen and compressed air as well as liquefied gases such as hydrocarbons, for example butane and isopentane, dimethyl ether and fluoro-hydrocarbons can be considered in particular as propellant for dispensing the product. However, it is also possible to dispense the product by means of mechanical systems such as springs or elastic materials with a restoring force such as elastomers.

Fields of application for the dispensing module as claimed in the invention can be found, for example, in the technical or pharmaceutical sector, in the sector of medical products, foodstuffs, cosmetics, personal hygiene, biocides, disinfectants or bleaching agents. In addition, the most varied product concepts can be realized: reactive systems can provide, for example, gas-generating systems (e.g. $CO_2$), hardening systems (e.g. chemical reactions such as chain lengthening, cross linking, coagulation, polymerization, in particular in the area of polyurethane chemistry), gelling systems with, where applicable, modification of viscosity, generation of active substances (e.g. chlorine, hypochlorite, $H_2O_2$, sulfur, iodine), enzymatic systems, acid-base systems, temperature-modifying systems (e.g. exothermic or endothermic mixtures) or adhesive systems. Further product concepts provide mixtures and the generating of specific material properties such as emulsions, dispersions, water-in-oil, oil-in-water, water-in-oil-in-water, odors, additive mixtures (AM), mixtures of active substances (e.g. vitamins), colors (e.g. coloring of objects and body parts), active disinfecting mixtures as well as certain flow or sliding properties.

LIST OF REFERENCES

- 1 Dispensing module
- 2 Outer casing
  - 21 First cylindrical part (bottom part)
  - 22 Second cylindrical part (top part)
  - 23 Radial connecting wall
  - 24 Channels
  - 25 Projection
  - 26 Radial ring-shaped shoulder
    - 261 Openings
  - 27 Fastening means
  - 28 Groove for the removable fork
- 3 Inner casing
  - 31 Cylindrical main part
  - 32 Truncated cone-shaped part
  - 33 Part forming a sleeve
    - 331 Radial ring-shaped groove
- 4 Two-way valve
  - 41 Valve body
  - 42 Collar-shaped part
  - 43 Faucet-shaped part
  - 44 Valve disk
  - 45 Rod
- 5 Housing
- 6 Piston unit
  - 61 First piston
    - 611 Ring-shaped groove
  - 62 Cylindrical part
  - 63 Sealing rim
    - 631 Sealing lips
  - 64 Second piston
    - 641 Latching means showing individual tabs for the piston head
    - 642 Pressure equalizing opening
- 7 Head of the second piston
  - 71 Radial wall
  - 72 Sealing rim
    - 721 Sealing lips
    - 722 Latching means
- 8 Retaining means
  - 81 Axial rim
  - 82 Radial ring-shaped groove
- 9 Removable fork

The invention claimed is:

1. A dispensing module (1) for two liquid products, said dispensing module including:

a first chamber (20) with a first wall, wherein the first chamber has a first opening, a first piston (61) which is displaceable abutting against the wall of a first chamber (20), a second piston (64) which is displaceable abutting against a wall of a second chamber (30), wherein latching means (62) are provided for coupling the two pistons (61, 64) during product dispensing, and at least one of the pistons has a piston head which is initially separated from the latching means and fastening means comprising individual tabs are provided in order to connect the piston head to the latching means, wherein the dispensing module (1) has a second chamber (30), the second piston (64 and 7) being displaceable abutting against the wall of said second chamber, wherein the second chamber (30) has a second opening characterized in that the coupling means have a part (62) which connects the first piston (61) to the second piston (64 and 7), wherein the first piston (61), the part (62) and the second piston (64 and 7) form one piston unit, wherein the first chamber (20) is realized in the shape of a circular ring and is defined in its central region by the part (62) of the piston unit (6) and wherein the second chamber (30) is arranged concentrically with respect to the first chamber (20) and above said first chamber and the first piston (61) and/or the second piston (64) have a piston head (7) which is initially separated from the latching (62) and once the dispensing module has been filled with the products is connected to the latching means (62) in an irreversible manner.

2. The dispensing module as claimed in claim 1, characterized in that the latching means (62) traverse the first chamber (20) and move the surface of the first piston (61) facing away from the opening of the first chamber (20) into contact with the surface of the second piston (64 and 7) facing away from the opening of the second chamber (30).

3. The dispensing module as claimed in claim 1, characterized in that fastening means (27, 33) are provided in order to connect the dispensing module to removal means (4) or means for closing the openings of the chambers.

4. The dispensing module as claimed in claim 1, characterized in that removal means (4) which are connected to the openings of the chambers (20, 30) are provided.

5. The dispensing module as claimed in claim 4, characterized in that the removal means include a two-way valve (4) or a two-way pump, wherein the first way is connected to the opening of the first chamber (20) and the second way is connected to the opening of the second chamber (30).

6. The dispensing module as claimed in claim 4, characterized in that the removal means include a metering device.

7. The dispensing module as claimed in claim 1, characterized in that closing means are provided in order to close the openings of the first chamber (20) and of the second chamber (30), wherein the closing means have an open and a closed position.

8. The dispensing module as claimed in claim 1, characterized in that a housing (5) which is fastened to the dispensing module (1) or to the removal means or to the closing means is provided.

9. The dispensing module as claimed in claim 1, wherein the dispensing module (1) has an inner casing (3) consisting substantially of a cylindrical main part (31), having an outside diameter corresponding substantially to the inside diameter of a second cylindrical part (22) of an outer casing (2), and having a length such that the bottom end, in the position locked into the outer casing (2), is aligned with the bottom end of a cylindrical part (22) of the outer casing (2), and wherein the inner casing (3) defines, with channels (24), the outlet lines for the product contained in the second chamber (30).

* * * * *